US009187910B2

(12) United States Patent
Tortorella et al.

(10) Patent No.: US 9,187,910 B2
(45) Date of Patent: Nov. 17, 2015

(54) CARPET TILING SYSTEM AND METHOD OF INSTALLATION

(71) Applicants: Frank Tortorella, Park Ridge, IL (US); Robert J. Sandlin, Rochelle, IL (US); Roxanne M. Charnock, Rochelle, IL (US)

(72) Inventors: Frank Tortorella, Park Ridge, IL (US); Robert J. Sandlin, Rochelle, IL (US); Roxanne M. Charnock, Rochelle, IL (US)

( * ) Notice: Subject to any disclaimer, the term of this patent is extended or adjusted under 35 U.S.C. 154(b) by 0 days.

(21) Appl. No.: 14/056,151

(22) Filed: Oct. 17, 2013

(65) Prior Publication Data

US 2014/0109509 A1 Apr. 24, 2014

Related U.S. Application Data

(60) Provisional application No. 61/715,027, filed on Oct. 17, 2012.

(51) Int. Cl.

| | |
|---|---|
| ***E04F 15/02*** | (2006.01) |
| ***A47G 27/04*** | (2006.01) |
| ***A47G 27/02*** | (2006.01) |

(52) U.S. Cl.

CPC ..... *E04F 15/02038* (2013.01); *A47G 27/02* (2013.01); *A47G 27/0293* (2013.01); *A47G 27/0475* (2013.01); *Y10T 428/16* (2015.01); *Y10T 428/23979* (2015.04)

(58) Field of Classification Search

CPC ..... E04F 15/02038; A47G 27/0475; A47G 27/0293; A47G 27/02; Y10T 428/23979; Y10T 428/16

USPC ..... 52/384, 387, 388, 177, 181, 391, 392, 52/476, 477, 592.1, 591.1, 676, 573.1, 52/396.1

See application file for complete search history.

(56) References Cited

U.S. PATENT DOCUMENTS

| | | | | |
|---|---|---|---|---|
| 3,120,083 | A | 2/1964 | Dahlberg et al. | |
| 3,247,638 | A | 4/1966 | Gay | |
| 3,654,051 | A | 4/1972 | Bieler | |
| 3,657,852 | A | 4/1972 | Worthington et al. | |
| 3,694,983 | A | 10/1972 | Couquet | |
| 4,571,353 | A * | 2/1986 | Gable, Jr. | 428/33 |
| 4,942,072 | A | 7/1990 | Chung | |
| 5,616,389 | A * | 4/1997 | Blatz | 428/45 |
| 6,098,354 | A * | 8/2000 | Skandis | 52/177 |
| 6,866,912 | B2 | 3/2005 | Higgins et al. | |
| 7,340,865 | B2 * | 3/2008 | Vanderhoef | 52/177 |
| 7,610,731 | B1 * | 11/2009 | Collison | 52/591.3 |
| 7,655,290 | B2 | 2/2010 | Verrue et al. | |
| 7,748,177 | B2 * | 7/2010 | Jenkins et al. | 52/177 |
| 7,993,717 | B2 | 8/2011 | O'Connor | |
| 8,048,506 | B2 | 11/2011 | Wise | |
| 8,186,116 | B2 * | 5/2012 | Anderson | 52/392 |
| 8,236,392 | B2 * | 8/2012 | Sawyer et al. | 428/17 |
| 8,468,772 | B2 * | 6/2013 | Oakey et al. | 52/747.11 |

(Continued)

*Primary Examiner* — Rodney Mintz
(74) *Attorney, Agent, or Firm* — Vedder Price, P.C.

(57) ABSTRACT

The present invention relates to a new type of floating carpet for covering any size surface, including entire rooms, by interlocking carpet covered bases on which resides a layer of carpet where each portion of the multiple tiles forming the carpet is a flat plastic base with side interlocking mechanisms made of male and mating female connectors to allow for the rapid design and installation of a modular layer of carpeting over existing surfaces, and more specifically multiple rectangular tiles each with a polymeric base on which is attached a piece of carpet for quick interlocking of side locking mechanisms on the polymeric base to secure adjacent carpet tiles into a carpet over a surface.

13 Claims, 6 Drawing Sheets

(56) References Cited

U.S. PATENT DOCUMENTS

| | | | | |
|---|---|---|---|---|
| 8,539,727 | B2 * | 9/2013 | Lui | 52/384 |
| 8,997,428 | B2 * | 4/2015 | Souchek et al. | 52/582.2 |
| 2002/0139070 | A1 * | 10/2002 | Berndt, Jr. | 52/177 |
| 2003/0154676 | A1 * | 8/2003 | Schwartz | 52/391 |
| 2003/0203152 | A1 * | 10/2003 | Higgins et al. | 428/92 |
| 2005/0016097 | A1 * | 1/2005 | Janesky | 52/384 |
| 2005/0066606 | A1 * | 3/2005 | Dolinski | 52/582.2 |
| 2005/0079316 | A1 | 4/2005 | Kobayashi | |
| 2008/0127593 | A1 * | 6/2008 | Janesky | 52/581 |
| 2008/0213529 | A1 * | 9/2008 | Gray et al. | 428/44 |
| 2008/0317997 | A1 | 12/2008 | Wright | |
| 2009/0081406 | A1 * | 3/2009 | Higgins et al. | 428/95 |
| 2009/0217614 | A1 * | 9/2009 | Cooper | 52/582.1 |
| 2010/0257801 | A1 * | 10/2010 | Anderson | 52/391 |
| 2011/0107720 | A1 | 5/2011 | Oakey et al. | |
| 2011/0167744 | A1 | 7/2011 | Whispell et al. | |
| 2012/0110804 | A1 * | 5/2012 | Hussmann | 28/100 |
| 2015/0107177 | A1 * | 4/2015 | Khongbantabam et al. | 52/311.2 |

* cited by examiner

CARPET TILING SYSTEM AND METHOD OF INSTALLATION

REFERENCE TO RELATED APPLICATION

The present patent application claims priority from and the benefit of U.S. Provisional Patent Application No. 61/715,027, filed Oct. 17, 2012, entitled CARPET TILING SYSTEM & METHOD OF INSTALLATION, which prior application is hereby incorporated herein by reference.

FIELD OF THE INVENTION

The present invention relates to a new type of floating carpet comprising multiple tiles with interlocking mechanisms to allow for the rapid design and installation of a modular layer of carpeting over existing surfaces, and more specifically multiple rectangular tiles each with a polymeric base on which is attached a piece of carpet for quick interlocking of side locking mechanisms on the polymeric base to secure adjacent carpet tiles into a carpet over a surface.

BACKGROUND

Historically, carpets are used mostly to help with multiple improvements in living and working areas. Carpets can be used indoors, outdoors, or even in vehicles. Red carpets are laid down at movie premieres to help an event cloak itself with a touch of luxury; sidewalks can be covered by carpets to protect the feet of transition athletes in a triathlon running barefoot from a swim area to a bicycle area. But the large majority of carpet is used for covering floors of different living and working quarters of individuals. While generally what is described herein is the use of carpet in the context of a house, a room, or an office, what is contemplated is the use of the new concepts broadly to any known situation where carpets are currently used.

Houses and workplaces greatly benefit from carpeting. Adding a carpet allows for a very drastic change and refreshment of the overall look and feel of any room. A good example of this dramatic shift is how the area where management works in manufacturing plants will be covered in carpeting.

There are multiple sizes and types of carpets in existence. Carpeting applies equally to larger and smaller areas alike. In the case of smaller areas, the term rug is often used. Rugs have historically been used to cover only a small portion or a strip of an area with carpet. One advantage of having small surface rugs is the capacity to design elaborate pieces of art made of silk or other noble materials, or to cut the carpets in shapes and designs desirable in a room.

Removable carpets are generally rolled into a tube for storage, removal, and cleaning. These removable rugs and carpets can slip as individuals move upon them unless they are secured down with some type of clips or nails. Even smaller carpets are often extremely difficult to clean and wash. Over time, odors collect in rugs until they must be retired. Large carpets to cover a long distance, like red carpets at a movie premiere, must be thin or they may be too heavy to lift by individuals. One other problem of rugs and carpet strips is creation of hazards and interface problems between two adjacent rugs or carpets. For example, someone wearing a high heel shoe may trip if the heel strikes the ground between two adjacent carpets at a joint interface. What is needed is a new method and system of carpeting that is modular, can be easily applied and removed at any situation, that does not create any tripping hazard.

One solution to limit the tripping hazards between rugs or patches of carpet is to cover an entire room by a single large carpet. In this case, there is also no completely finished surface below a room-size carpet. Large room-size carpets are installed by specialists, using long rolls cut to size. Disadvantages of using room-size carpets include the inability to remove them for cleaning and the need to manage odors and humidity. For example, if a dog has an accident, the urine will be drawn into the carpet and will have to be dealt with.

Vacuum cleaners, while capable to collecting dust and some debris accumulating in the upper portion of a carpet, may not be able to dislodge particles trapped below the surface. With time, these permanent carpets will also be damaged in a single area where an accident occurred or where excessive wear is anticipated.

What is needed is a new type of carpeting solution that is easy to clean and easy to install, and offers the advantages of both of these carpeting solutions while having none of the drawbacks.

SUMMARY

The present invention relates to a new type of floating carpet for covering any size surface, including entire rooms, by interlocking carpet covered bases on which resides a layer of carpet where each portion of the multiple tiles forming the carpet is a flat plastic base with side interlocking mechanisms made of male and mating female connectors to allow for the rapid design and installation of a modular layer of carpeting over existing surfaces, and more specifically multiple rectangular tiles each with a polymeric base on which is attached a piece of carpet for quick interlocking of side locking mechanisms on the polymeric base to secure adjacent carpet tiles into a carpet over a surface.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Carpets, laminated floors, gym flooring, and other types of surfacing are often needed on surfaces to help improve or change the functionality of a location. In some cases, a room or surface is already covered with a first type of covering and what is needed is the capacity to place a floating second covering on top of the first type of covering. This invention relates to the installation of a second covering such as carpet in the current preferred embodiment over a first covering such as laminated wood in the current preferred embodiment. While one type of secondary covering is shown over a first type of first covering, what is disclosed is a system and method of installation that can be applied to any surface, even over a flat surface without covering like grass, ground, or cement.

Figure 1:
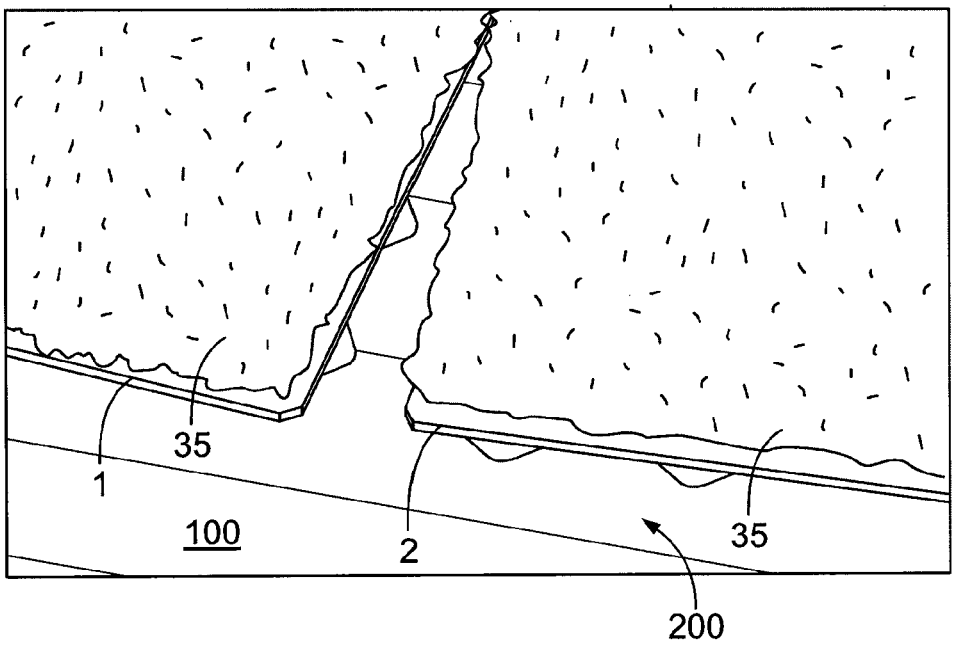
FIG. 1 a picture of two adjacent carpet tiles on a laminated wood floor according to an embodiment of the present disclosure.

FIG. 1 shows a flat horizontal surface 100 such as a floor covered by laminated wood or any other known surface upon which two or more adjacent carpet tiles 1 and 2 are placed. While the use of the carpet tiles 1 and 2 are shown on a flat horizontal surface, one of ordinary skill in the art will know that any flat surface can be used and covered by the tiles 1 and 2, including walls or even ceilings.

Figure 2:
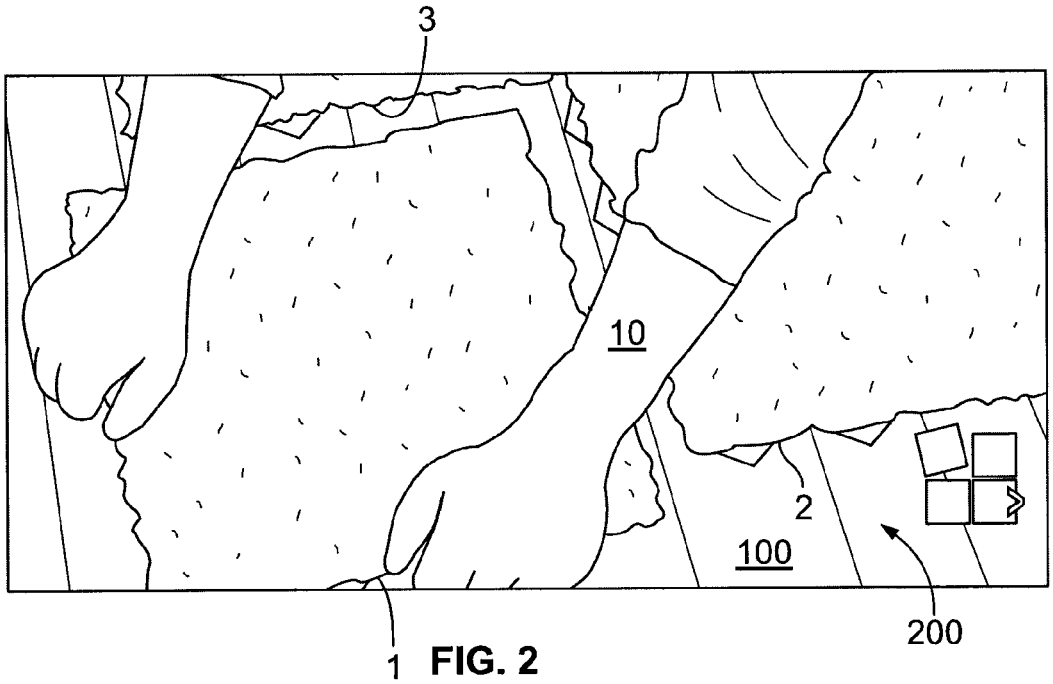
FIG. 2 is a picture of a user sliding in a carpet tile on a portion of floor according to an embodiment of the present disclosure.

FIG. 1 shows generally the elements of a system 200 for covering a flat horizontal surface 100 where a plurality of tiles, here shown by two tiles 1 and 2, are aligned at their side edges so the different male and female connectors as explained in greater detail below can interlock. FIG. 2 shows how, in one embodiment, a user 10 can use his or her hands to slide a tile 1 into position to rest upon adjacent tiles 2 and 3. In the example shown, locks described hereinafter are made in a V shape and slide into the adjacent tiles. One of ordinary skill in the art of interlocking tiles will understand that in some cases or models, the tiles may be secured permanently to each other using one-way locking tabs, glue, bolts, or screws if the system 200 is used to cover a flat horizontal surface permanently. In other cases or models, the system 200 can be used for a short period of time or may require the frequent replacement of some of the tiles to compensate for wear. In these models or cases, the connection between adjacent tiles can be temporary.

FIGS. 1 and 2 also do not show the use of an underlying carpet, a foam, or other underlying layer between the tiles 1, 2, and 3 and the flat horizontal surface 100. One of ordinary skill in the art in the covering of surfaces knows that small foam or other layers can be used to attenuate sound, correct floor irregularities, and help protect and prepare the surface 100 upon which the system 200 can be placed.

In the primary embodiment shown in the figures, one single geometry of flat square tile can be used to cover a surface. One of ordinary skill in the art knows that in the art of covering a surface with tiles, two or more different shape tiles can be used in tandem to create different effects and shapes. For example, a user wanting to cover a surface with floor tiles can create different edges, shapes, or a mosaic of different colors by alternating the shapes, sizes, and colors of the tiles selected. One of ordinary skill in the art will recognize that while one square and single color carpeted tile is shown, what is contemplated is the use of this technology on any type of tiling system currently in use on ordinary tiles.

Figure 3:
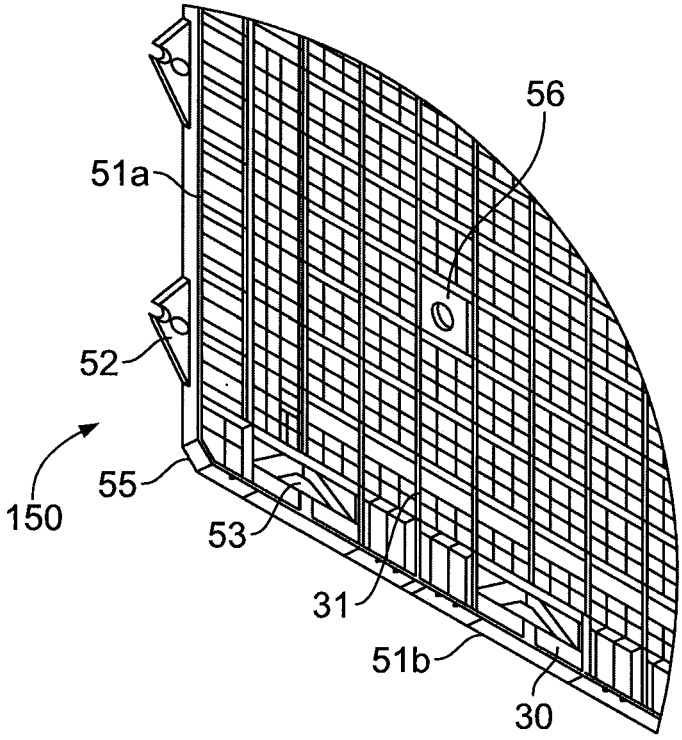
FIG. 3 is an isometric partial view of a corner of a carpet tile base according to an embodiment of the present disclosure.

FIG. 3 is an isometric illustration of a portion of a flat square horizontal interlocking tray 150 showing with greater detail a portion of the underside 30 of the tray 150. Since the system 200 must be able to be adapted to any shape and size of room to be covered, what is contemplated is the need to cut and trim down any single tile to fit in place. To help guide and direct the cut of the tiles to precise dimensions, as shown, the underside 30 of a plate or horizontal interlocking tray 150 can include different guides 31, ridges or other weaknesses, such as for example saw guides or snap-off guides, to help with the installation. In another embodiment, a user can purchase square tiles of a fixed dimension (e.g., 12"×12") along with a handful of partial tiles (e.g., 12"×6") to help limit the need to cut and trim down a tile to the right dimension.

What is shown at FIG. 3 is a portion of a horizontal interlocking tray 150 including two sides, each having an outer horizontal edge 51. The portion shown of one edge 51*a* has a male connector 52 shown in a V shape while the portion shown of the second edge 51*b* has a female connector 53. The area defined within the outer edges 51 is a flat plate 150 with an underside 30 for laying down on a flat surface 100 as shown at FIGS. 1 and 2, and an upper side opposite to the underside 30.

In the design as shown guides and ridges 31 can be made at regular intervals in the tile underside 30 to help with any potential cut or change in any dimension. As shown, these ridges 31 are made in two dimensions but what is contemplated is the use of these ridges in any direction. One of ordinary skill in the art will understand that in cases where the horizontal interlocking tray 150 is made of polymer or other types of material having inherent flexibility, these ridges 31 can be made as ribs using ribbing techniques to help reinforce the horizontal interlocking tray 150 and limit the thickness of the horizontal interlocking tray 150. As shown, rounded corners 55 can also be included to help adjacent tiles interlock. Another useful feature are small areas for placing support feet 56 where the mold is attached.

Figure 4:
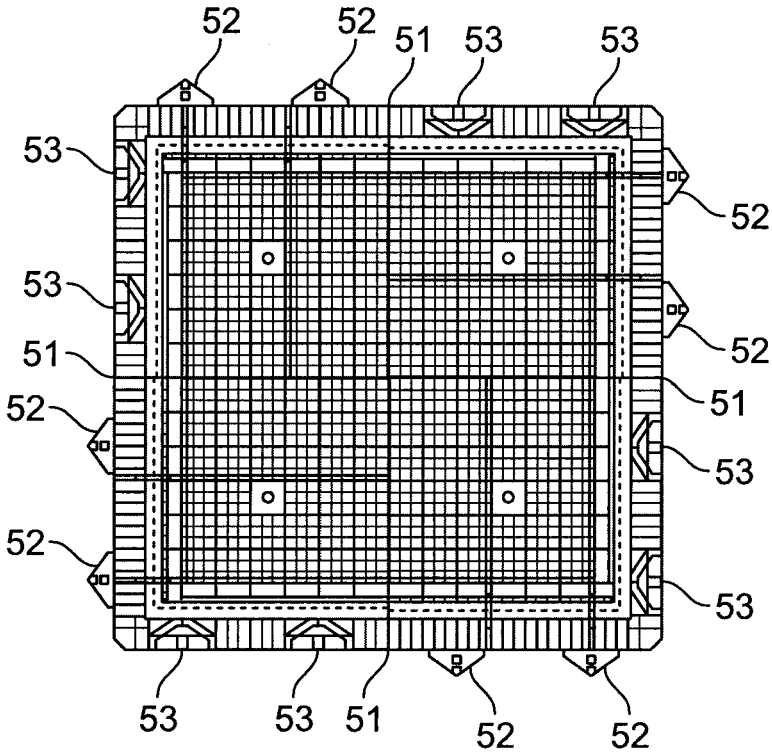
FIG. 4 is a bottom view of the carpet tile shown at FIG. 3 according to an embodiment of the present disclosure.
Figure 5:
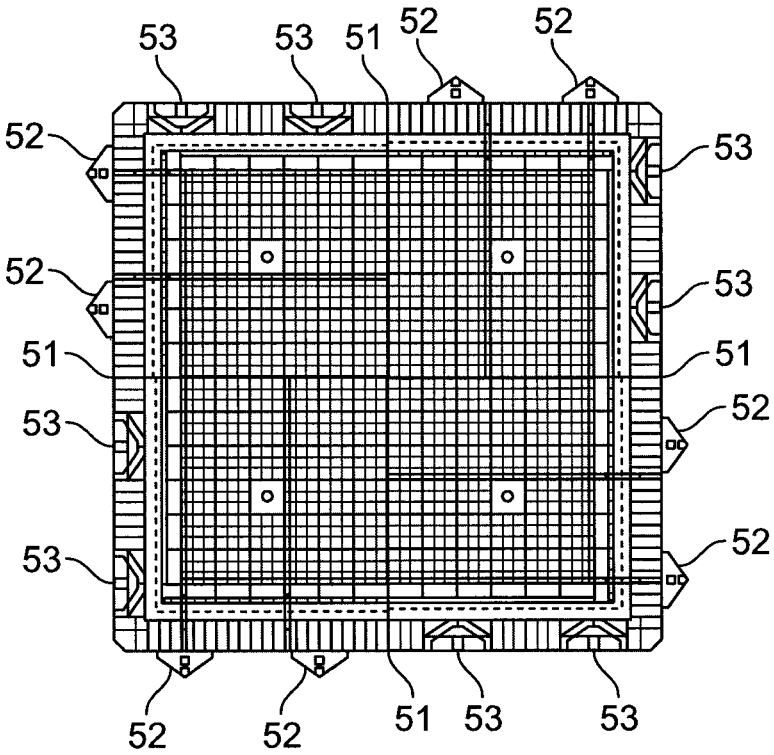
FIG. 5 is a top view of the carpet tile shown at FIG. 3 according to an embodiment of the present disclosure.

Each of the four sides of a tray 150 as shown at FIGS. 4 and 5 includes an outer horizontal edge 51 on the four sides each with two V shaped male connectors 52 and two V shaped female connectors 53. As shown, each of the four sides of the tiles 1, 2, and 3 is designed to mate and interlock with an adjacent tiles 1, 2, and 3 as shown at FIGS. 1 and 2 in such a way that the two male connectors 52 from a first tile will slide into the two adjacent female connectors 53 of the second tile. What is shown is the use of four V shaped male-female connectors but what is contemplated is the use of any number of connectors or any type of connector to help connect adjacent carpet tiles including locks, slips, screws, little clips, etc.

In one embodiment as shown at FIG. 3, each male connector 52 includes a centering lug 60, a tab 61, and a snap lock piece 62. These features as either the male or female part of one possible connector 52, 53 are shown more clearly on a snap-on side piece 80, also called trims, as illustrated on FIGS. 9 and 10.

Figure 7:
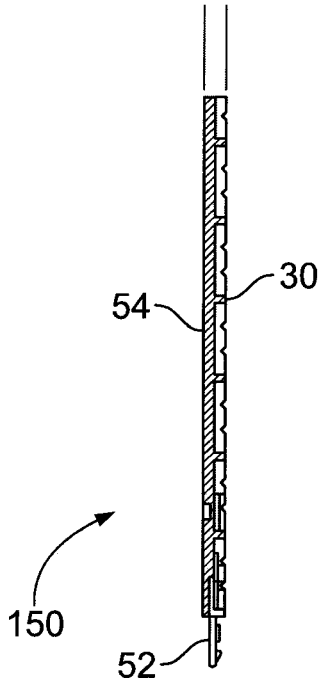
FIG. 7 is a side view of the carpet tile shown at FIG. 3 according to an embodiment of the present disclosure.

FIG. 7 shows a side view of a section of the base plate 150 (also described as a horizontal interlocking tray) of a tile with an end male connector 52 on the outer edge 51. As shown, the tray 150 includes both an upper side 54 and a lower side 30.

Figure 8:
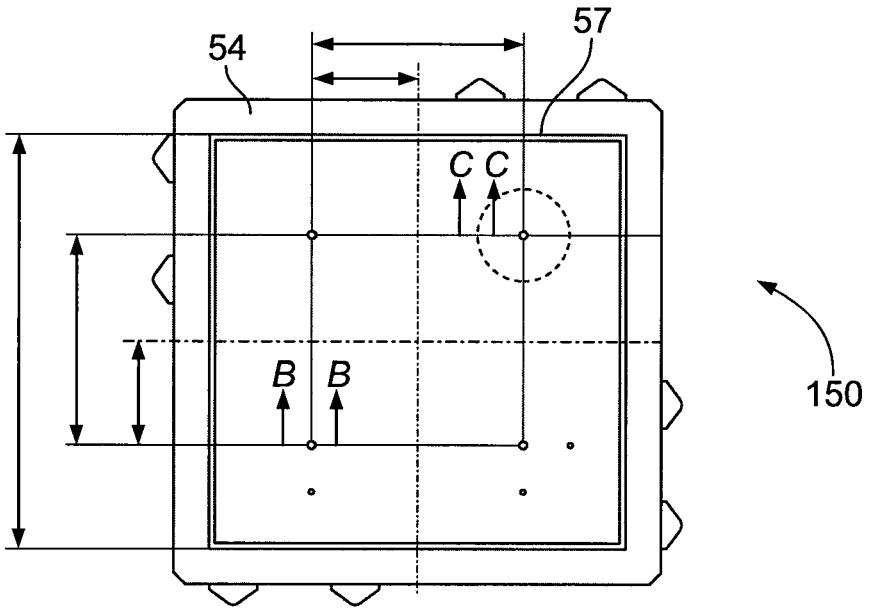
FIG. 8 is a different top view of the carpet tile without cutting lines according to another embodiment.

FIG. 8 shows how the upper side 54 or the upper portion of the base plate of the tile can be made with a small ridge 57 to help glue or attach a square of carpet, or secure an intermediate layer to the upper side 54 of the tray 150. Once again, while one configuration is shown, what is contemplated is the use of any possible configuration or system to help attach carpet to the upper portion of the base plate.

As shown at FIG. 1, a textured carpet 35 is attached to the upper side 55 of horizontal interlocking tray 150 for securing the carpet 35 to the flat interlocking tray 150. In this case, the male connector 52 and the female connector 53 located on the outer horizontal edge 51 are designed to interlock each with a different adjacent carpet tile laid down on the flat surface.

Figure 9:
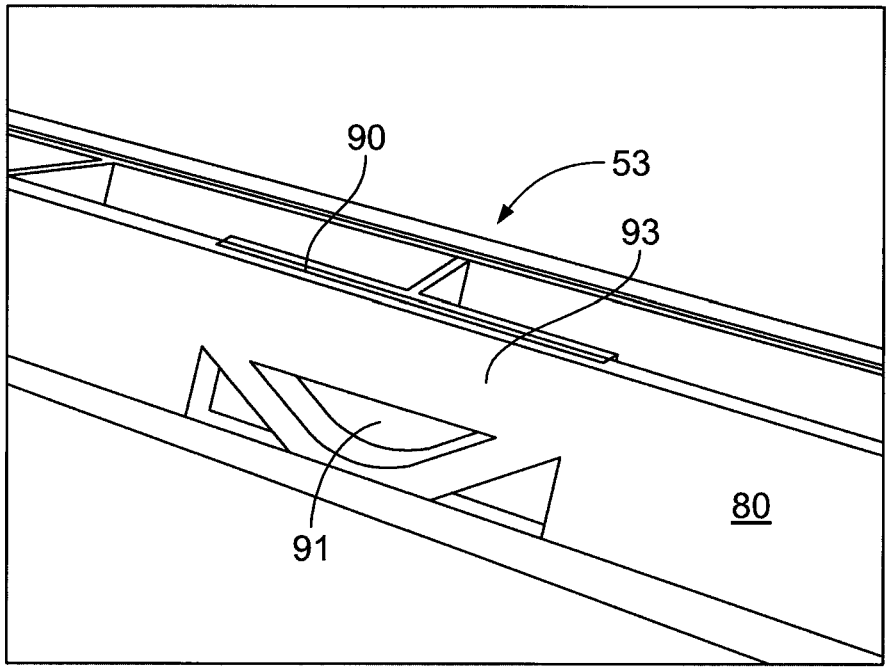
FIG. 9 is a picture of a semi-round edge block illustrating a female connector.
Figure 10:
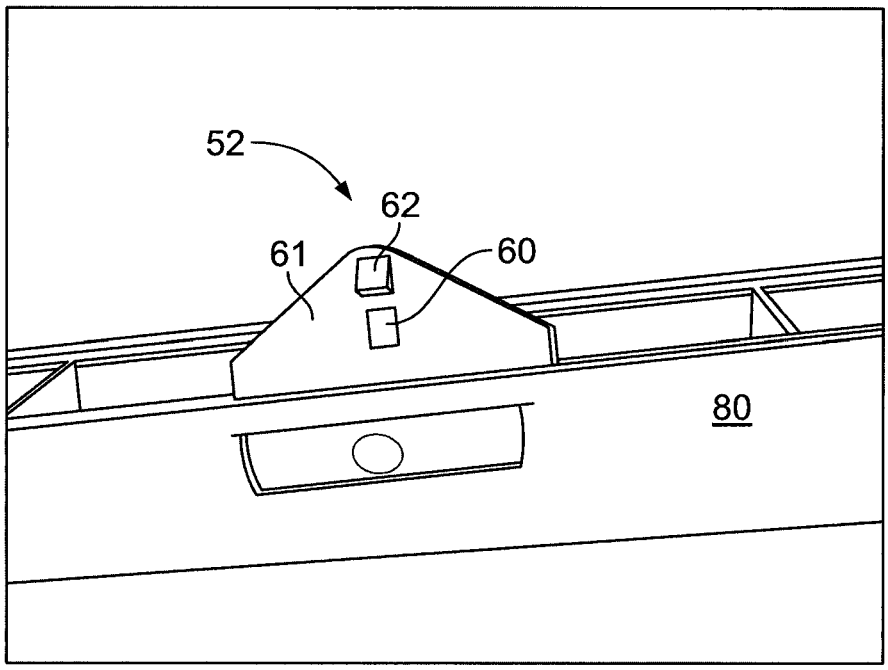
FIG. 10 is a picture of a semi-round edge block illustrating a male connector.

FIGS. 9 and 10 show two different portions of a trim 80 designed to be clipped to the side of the tiles in places where a transition must be made between the carpet area and the floor surface 100 on which the tiles 1 and 2 are placed. The male 52 and female 53 connectors on these trims 80 are easier to see without all of the additional features and ribs of the tiles 1 and 2.

In this embodiment, an opening 90 is made to form the female connector 53 as shown at FIG. 9. The male connector 52 including all of its features is slowly slid into the opening 90 until the tab 61 and the lock piece 62 slide into place. The bottom opening 91 allows the use of a tool or screwdriver to push the lock piece 62 away from the small bar 93 to allow the male connector 52 to slide back out.

Figure 6:
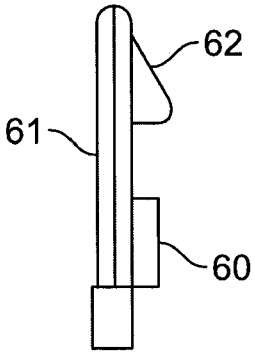
FIG. 6 is a detail of one of the V shaped notches located around the carpet tile shown at FIG. 3.

As the male connector 52 is pushed in the opening slit 90 of the female connector 53, it is centered by the centering lug 60 until the snap lock 62 passes the small bar 93 and then is capable of snapping in position. One advantage of the snap lock mechanism and an opening 90 on the female connector 53 is the capacity to unlock two adjacent tiles 1 and 2 by using a screwdriver or other hand tool to push up the snap lock 62 away and pull the male connector 52 out of the female connector 53. The tab 61 is also used as a slightly rigid and deforming body that will bend slightly as the snap lock 62 slides over the small bar 93. FIG. 6 shows with greater detail the tab 61 with the centering lug 60 and the snap lock 62.

In one embodiment, the top side 54 of a tray 150 may be first covered with a padding layer which is then covered with a carpet layer. In one embodiment the interlocking tray has a thickness of 3/16 of an inch and the padding layer has a thickness of 3/8 of an inch. As will be clear to one of skill in the art, a variety of thicknesses of tray, padding, and carpet may be used. What is contemplated is the use of any padding and carpet known in the art. In another embodiment, the underside 54 includes a marking to indicate a preferred orientation of the tile 1 as part of a fully assembled carpet made of a plurality of tiles 1, 2, and 3. The marking (not shown) can be an arrow indicating the grain of a textured carpet.

In addition to a simple carpet tile 1, 2, and 3, each tile can be part of a removable carpet 200 also described as a system for covering a floor or a surface 100. This removable carpet 200 can include a plurality of carpet tiles 1, 2, and 3 above. Each tile 1, 2, and 3 has at least a trim 80 with at least a mating male connector 52 for the female connector 53 of one of the other carpet tiles 1, 2, or 3, and a mating female connector 53 for the male connector 52 of one of the other carpet tiles 1, 2, or 3.

Figure 11:
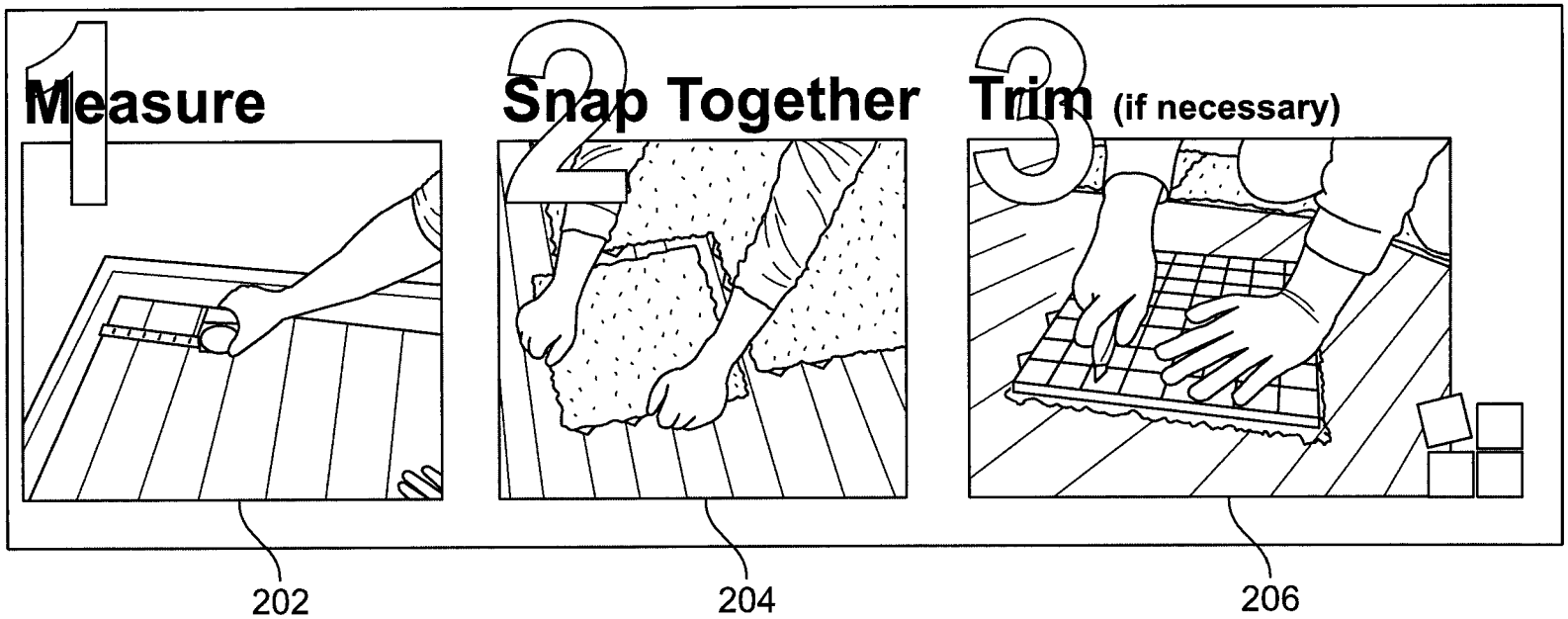
FIG. 11 is an illustration showing the different steps of installing carpet using the carpet tiles.

FIG. 11 shows a method of what is contemplated using a series of tiles (e.g., tiles 1, 2, and 3 shown in FIGS. 1 and 2) which are shown as squares but that can be of any shape that can be interlocked together to cover a surface. A user will obtain a series of carpet tiles. In one embodiment the carpet will be pre-attached on the base of the tile, while in another embodiment, the base tile will be sold independently and a user will in a first step have to cut the carpet in the right sections and attach the carpet to the base tile using an adhesive or any other mode to attach used in this art.

FIG. 11 shows the tiles as already found with carpet on the upper side. First, in step 202, the room is measured to determine the number of tiles to install. Next, in step 204, tiles are attached or snapped together to cover the desired area. Finally, in step 206, tiles are trimmed if necessary. To trim a tile, the user then can flip the carpet tile upside down, use the carpet thickness as protective distance and using a tool such as a short knife blade with a blade that is shorter than the thickness of the carpet to cut along lines made in the bottom surface of the base tile.

In an embodiment, semi-round edges or other rim boards commonly used in the industry are used to help create finished edges to the carpet tiles. For example, a design can include an internal opening area such as a dance floor where each edge is covered by a trim or edge piece. In an embodiment, these rim boards are produced to have male 52 and female 53 connectors so as to interconnect with the outer female 53 and male 52 connectors, respectively, on the tiles. In other words, each of the rim board would have at least a mating male connector for the female connector of one of the carpet tiles, and a mating female connector for the male connector of one of the carpet tiles.

The system for use of carpet tiles is aesthetically pleasing and can create a wall-to-wall carpet. Alternatively, a portion of room may be covered. One main advantage of using a carpet tile is that the room in which the carpet is installed does not need to be emptied of furniture. Once the old existing carpet is removed or any other type of floor is found, the furniture can be displaced to one end of the room as the tiles are assembled. Once in the middle of the room, the furniture can be lifted and placed on the partly completed carpet, allowing for completion of the work.

In order to cut a tile to any needed dimension to fit a room, what is contemplated is a hand tool such as a utility knife with a sharp blade. The carpet tiles can be installed over plywood, concrete, vinyl, hardwood, tile or any surface. In a preferred embodiment, the surface is one that is structurally sound, clean, dry, and smooth. In a preferred embodiment, if concrete is used for the surface it is fully cured and dry before installation of the tiles. In one embodiment, the surface is a subfloor with a with a variation of no more than 1/8 inches in 6 feet.

What is claimed is a method in accordance with the present invention for installing tiles. In a preferred embodiment, the subfloor is first cleared of any debris that would prevent the tiles from lying flat, for example by sweeping or vacuuming the surface. As will be clear to one of skill in the art, this is only necessary if debris are present on the subfloor. A location is determined to start the installation. In a preferred embodiment, installation begins in one corner of the room. The width and length of the room is measured to obtain the overall dimensions of the area to be covered. Based on these measurements, the number of tiles (including both complete and partial tiles) to be installed is determined. For example, the measured dimensions or a room can be a total of 5'2"×7'3". The number of tiles necessary may be determined by rounding up to cover a surface larger than the measured surface. In the above example, the surface to cover before trimming would be 6'×8", yielding a total of 48 tiles (6×8) if square tiles of 12"×12" (1'×1') are used.

In one embodiment, tiles of uniform shape, size, and color may be used. In an alternate embodiment, different types or styles of tiles are used and are placed in either a predetermined or random pattern. For example, two or more different colors of tiles may be used. Each color of tile may come in a separate box. During installation, these tiles of different colors may be mixed randomly to help generate the best degree of variations between the different elements. In a preferred embodiment, tiles from at least three boxes, each containing for example a different color of tile, are used. During installation, these different-colored tiles are mixed, either randomly or in a predetermined pattern. In a preferred embodiment, all of the tiles of each color come from the same dye lot to ensure matching colors.

The first tile to be installed is then placed flat on the ground. In a preferred embodiment, a marking on the bottom surface of each tile indicates the orientation in which each tile should be placed. For example, the marking could be an arrow. The marking could further indicate the grain of the texture of the carpet. In this example, the tiles would be installed with all of the arrows facing in the same direction. Doing so would orient the grain of the carpet on all of the tiles in a single direction.

A second tile is then placed flat on the ground next to the first, in the proper orientation. The two tiles are then interlocked by lining up the tabs and pressing the tiles together firmly until they lock. As will be clear to one of skill in the art, a tile may be connected to a group of two or more tiles that have already been interconnected together. Accordingly, the steps are repeated until each of the predetermined number of tiles has been installed.

Further, the method concludes with trimming the last row and/or column of tiles if necessary. Tiles may be trimmed during installation to cover only the desired area. Once the width of the room is calculated, if the width of the last row is less than a certain fraction of the full tile, the first row may be trimmed as well. In the above example where the room is 5'2", then in theory the last row would be made of tiles of only 2". In order to increase the thickness of the last row, the first row may be trimmed by 4", reducing the first row from the full 12" down to 8". This will allow the last row to be 6" in width (adding the 4" removed from the first row to the 2" left).

Additionally, in a preferred embodiment, a minimum of ¼" of expansion space is left around the perimeter of the room. To install the last row of tiles around the perimeter of the area, the tiles are cut to the correct size leaving at least a ¼" gap between the tile and the wall. The tile may be flexed slightly if necessary and the tile next to it lifted so the tabs can lock into place. If it is necessary to unlock carpet tile, a tool such as a small utility knife may be slid between two tiles and twisted until the tiles unlock. Alternatively, a user may use their hand to lift the tiles and push the tab upwards to unlock the tiles.

In an embodiment, the ¼" expansion space is created between the tiles and the wall by cutting off the tabs on the outer edges of the tiles on the perimeter of the room. The tabs may be removed, for example, by scoring the tabs with tool such as a utility knife and snapping them off. In one embodiment, the tabs on the outer edges of the perimeter carpet tiles are cut from the bottom. In an embodiment, the tabs are created from a material (e.g., a type of plastic) which allows for the tiles to be snapped off after a score is made on the bottom along one of the notched lines using a tool such as a sharp utility knife. Once the base plate is separated, a cutting instrument like a knife is used to carefully cut through the pad and carpet.

It is understood that the preceding is merely a detailed description of some examples and embodiments of the present invention and that numerous changes to the disclosed embodiments can be made in accordance with the disclosure made herein without departing from the spirit or scope of the invention. The preceding description, therefore, is not meant to limit the scope of the invention but to provide sufficient disclosure to one of ordinary skill in the art to practice the invention without undue burden.

What is claimed is:

1. A carpet tile, comprising:

a horizontal interlocking tray having an outer horizontal edge with at least a male connector and a female connector, where an area defined within the outer horizontal edge is a plate with an underside for laying down the carpet tile on a flat surface and an upper side opposite to the underside; and a textured carpet attached to the upper side of the horizontal interlocking tray for securing the carpet to the horizontal interlocking tray;

wherein the male connector and the female connector on the outer horizontal edge are designed to interlock each with a different adjacent carpet tile laid down on the flat surface; and wherein the male connector comprises a tab protruding from the outer horizontal edge substantially parallel to the flat surface with a centering lug protruding from the tab in a vertical direction that is perpendicular to the flat surface and a snap lock configured to deflect in the vertical direction, and the female connector comprises a vertical slot in the outer horizontal edge configured to receive the tab and a horizontal opening configured to receive the snap lock.

2. The carpet tile of claim 1, wherein the tile further includes a padding layer secured to the upper side of the tray and to an underside of the textured carpet.

3. The carpet tile of claim 2, wherein the interlocking tray has a thickness of 3/16 of an inch, and the padding layer has a thickness of ⅜ of an inch.

4. The carpet tile of claim 1, wherein the underside includes a marking to indicate a preferred orientation of the tile as part of a fully assembled carpet made of a plurality of tiles.

5. The carpet tile of claim 4, wherein the marking is an arrow indicating the grain of the textured carpet.

6. A removable carpet, comprising:

a plurality of carpet tiles, each tile including a horizontal interlocking tray having an outer horizontal edge with at least a male connector and a female connector, where an area defined within the outer horizontal edge is a plate with an underside for laying down the carpet tile on a flat surface and an upper side opposite to the underside, and a textured carpet attached to the upper side of the horizontal interlocking tray for securing the carpet to the horizontal interlocking tray, and wherein the male connector and the female connector on the outer horizontal edge are designed to interlock each with a different adjacent carpet tile laid down on the flat surface; and at least a trim with at least a mating male connector for the female connector of one of the carpet tiles, and a mating female connector for the male connector of one of the carpet tiles;

wherein the underside includes a plurality of guides, each guide comprising an indentation in the underside running substantially across the underside, and a plurality of ribs, each rib extending perpendicularly away from the tile and running substantially across the underside; and wherein the e connector comprises a tab protruding from the outer horizontal edge substantially parallel to the flat surface with a centering lug protruding from the tab in a vertical direction that is perpendicular to the flat surface and a snap lock configured to deflect in the vertical direction, and the mating female connector comprises a vertical slot in the trim configured to receive the tab and a horizontal opening configured to receive the snap lock.

7. The removable carpet of claim 6, wherein a first carpet tile of said plurality of carpet tiles is placed adjacent to and approximately ¼ inch from a first wall, a second carpet tile of said plurality of carpet tiles is placed adjacent to and approximately ¼ inch from a second wall, and said removable carpet spans a distance between said first carpet tile and said second carpet tile.

8. The removable carpet of claim 6, wherein at least one tile further includes a padding layer secured to the upper side of the tray and to an underside of the textured carpet.

9. The removable carpet of claim 8, wherein at least one interlocking tray of at least one tile has a thickness of 3/16 of an inch, and the padding layer has a thickness of ⅜ of an inch.

10. The removable carpet of claim 6, wherein the underside of at least one tile includes a marking to indicate a preferred orientation of the tile as part of the removable carpet.

11. The removable carpet of claim 10, wherein the marking is an arrow indicating the grain of the textured carpet.

12. The removable carpet of claim 6, wherein each of the tiles is square in shape.

13. The removable carpet of claim 12, wherein each tile is 12 inches by 12 inches in size.

* * * * *